United States Patent [19]

Schwalberg

[11] 4,021,990

[45] May 10, 1977

[54] VENEER ANCHOR AND DRY WALL CONSTRUCTION SYSTEM AND METHOD

[75] Inventor: Bernard J. Schwalberg, Brooklyn, N.Y.

[73] Assignee: Hohmann & Barnard, Inc., Hauppauge, N.Y.

[22] Filed: Jan. 27, 1976

[21] Appl. No.: 652,867

[52] U.S. Cl. ..... 52/714; 52/379; 52/712; 52/564

[51] Int. Cl.[2] ..... E04B 1/38; E04B 1/16

[58] Field of Search ..... 52/714, 713, 235, 712, 52/564, 379, 428, 562, 568, 565, 753 C; 110/1 A; 248/295, 311.1, 315, 316 D, 311 R

[56] References Cited

UNITED STATES PATENTS

| | | | |
|---|---|---|---|
| 814,134 | 3/1906 | Hood | 52/714 |
| 819,869 | 5/1906 | Dunlap | 52/714 |
| 1,206,203 | 11/1916 | Brockway | 248/295 |
| 1,708,696 | 4/1929 | Hellerman | 52/379 |
| 1,794,684 | 3/1931 | Handel | 52/713 |
| 1,854,633 | 4/1932 | Stephens | 52/713 |
| 3,341,998 | 9/1967 | Lucas | 52/713 |
| 3,350,831 | 11/1967 | Miller | 52/714 |
| 3,377,764 | 4/1968 | Storch | 52/426 |
| 3,568,389 | 3/1971 | Gulow | 52/714 |

*Primary Examiner*—Price C. Faw, Jr.
*Assistant Examiner*—Robert C. Farber
*Attorney, Agent, or Firm*—Philip D. Amins

[57] ABSTRACT

There is provided a veneer anchor for use in a dry wall construction system. The veneer anchor comprises a plate member having a vertically projecting bar portion secured thereto and disposed in substantially parallel relationship with said plate member. The anchor is employed to secure a wall board to a vertical channel or standard framing member. Thereafter, a mason inserts a wall-tie between the plate member and projecting bar portion and the wall-tie is built into the outer wythe of the wall system. The wall-tie is capable of vertical movement and thus, vertical adjustability along the length of the projecting bar portion.

34 Claims, 8 Drawing Figures

FIG.1
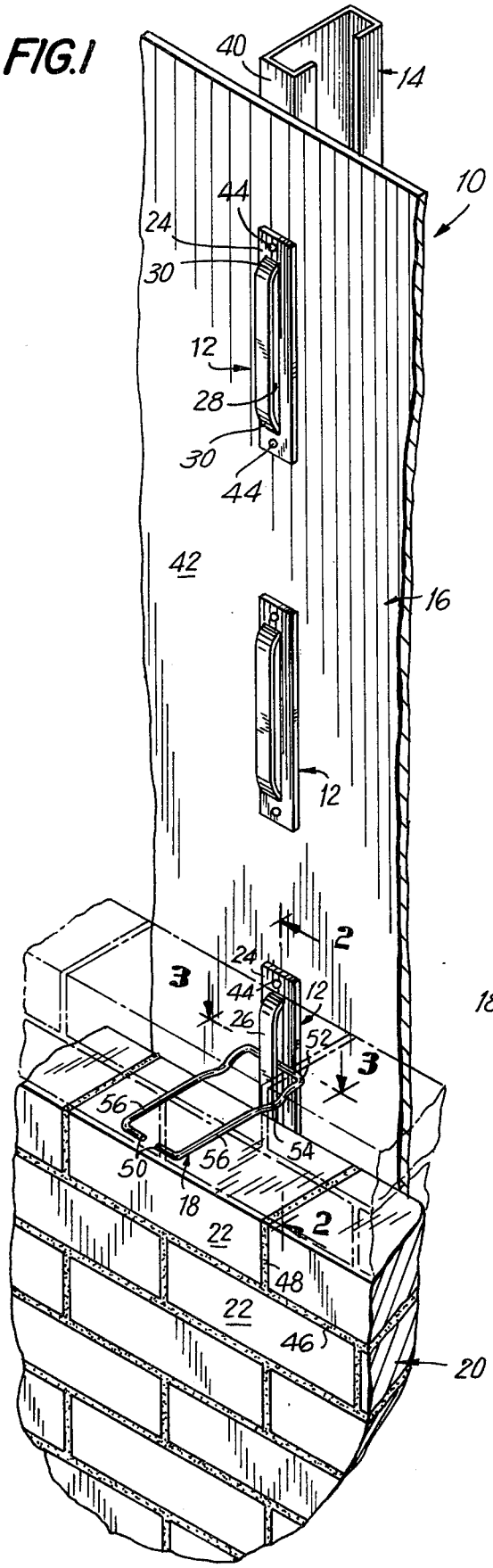
FIG.2
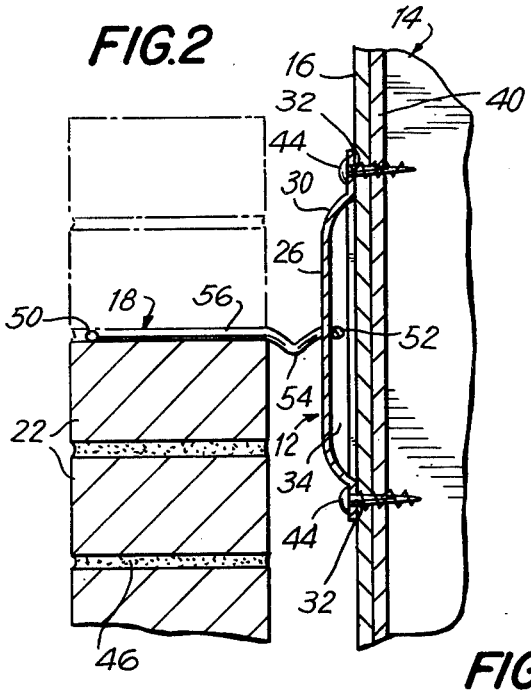
FIG.3
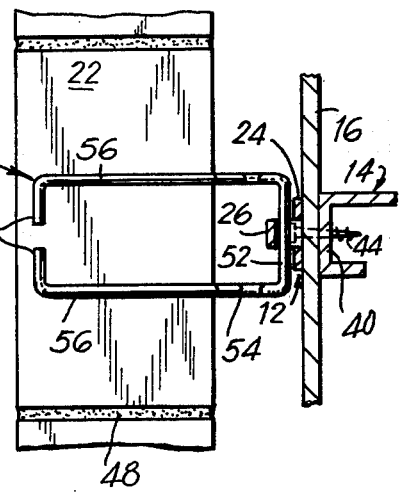
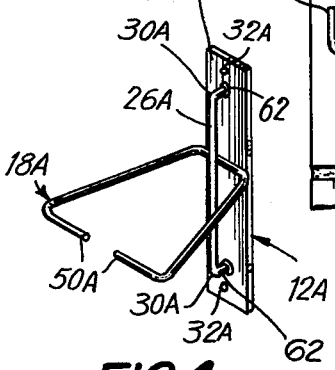
FIG.4

VENEER ANCHOR AND DRY WALL CONSTRUCTION SYSTEM AND METHOD

The present invention provides a new and novel veneer anchor apparatus for use in dry wall construction systems.

BACKGROUND OF THE INVENTION

Heretofore in dry wall construction systems, it has been the normal practice for a carpenter to secure or fasten the dry wall to the channel or standard framing members utilizing sheet metal screws and to thereafter have a mason secure the inner end of wall-ties to the previously secured dry wall and framing member assembly. It will therefore be apparent that there are two fastening operations required by two different trades to accomplish the preliminary securements prior to the construction of the outer wythe. This method is time consuming and thus more costly than one wherein a singular fastening operation can be utilized and performed.

SUMMARY OF THE INVENTION

Accordingly, it is the primary object of the present invention to provide a new and novel dry wall construction system and method employing a new veneer anchor construction wherein only a single fastening operation by a single construction tradesman is required.

It is another object of the present invention to provide a new veneer anchor construction comprising a plate member having a projecting bar portion secured thereto and projecting therefrom in substantially parallel relationship.

It is still another object of the present invention to provide a veneer anchor construction of the foregoing type which is capable of simple and easy simultaneous securement to a dry wall and a channel or standard framing member of an edifice.

It is yet another object of the present invention to provide a veneer anchor construction of the foregoing type which is capable of having a wall-tie easily secured therewith and which wall-tie is longitudinally adjustable on the projecting bar portion of said anchor.

It is still a further object of the present invention to provide a veneer anchor and dry wall construction system, as aforesaid, which is capable of providing limited lateral adjustability of the wall-tie with respect to said projecting bar portion.

It is yet another object of the present invention to provide a new and novel veneer anchor and dry wall construction system of the foregoing type wherein the wall-tie employed in conjunction therewith is prevented by means of the veneer anchor plate member from projecting into and damaging the dry wall board.

It is yet a further object of the present invention to provide a veneer anchor construction of the foregoing type wherein the plate member and projecting bar portion are formed integrally with one another and said projecting bar portion is punched-out from said plate member.

It is still another object of the present invention to provide a veneer anchor construction wherein the projecting bar portion has the ends thereof welded or otherwise secured to the plate member of the veneer anchor.

Moreover, it is yet a further object of the present invention to provide a new and novel veneer anchor apparatus for use in dry wall construction systems which is relatively easy and economical to manufacture.

BRIEF DESCRIPTION OF THE DRAWINGS

The foregoing and other objects, features and advantages of the present invention will become more apparent from the detailed description hereinafter when considered in conjunction with the drawings wherein:

FIG. 1 is a partial perspective view of a dry wall construction system fabricated in accordance with the principles of the present invention and utilizing a first embodiment of the new and novel veneer anchor apparatus thereof;

FIG. 2 is a sectional view taken on the line 2—2 of FIG. 1;

FIG. 3 is a sectional view taken on the line 3—3 of FIG. 1;

FIG. 4 is a perspective view of a second embodiment of the veneer anchor construction of the present invention;

DETAILED DESCRIPTION OF THE PREFERRED EMBODIMENTS

Figure 5:
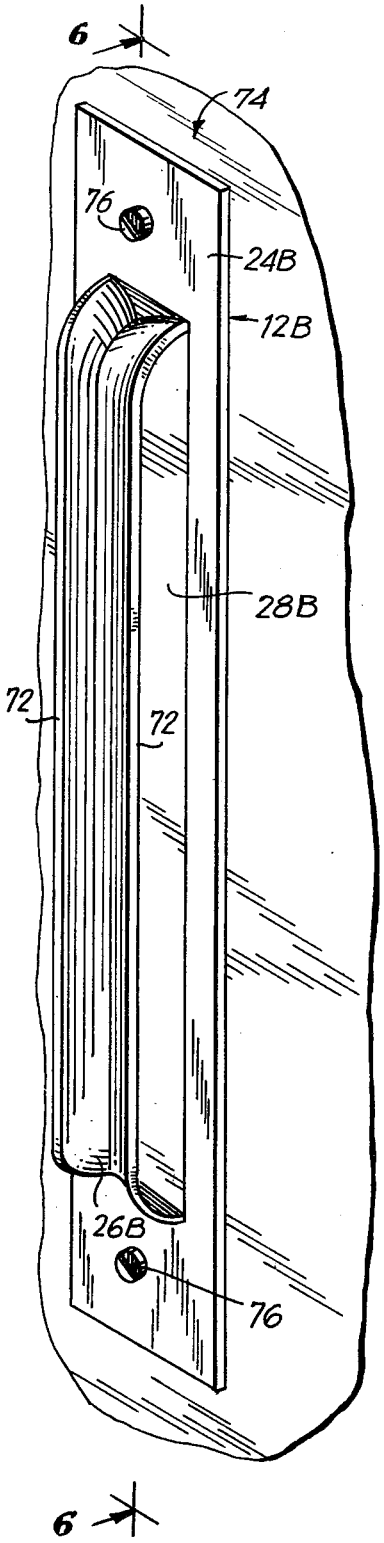
FIG. 5 is a perspective view of a third embodiment of the veneer anchor construction, similar to the first embodiment depicted in FIGS. 1 and 2.

Referring now to the drawings, and more particularly, to FIG. 1 thereof, there is depicted the new and novel dry wall construction system, generally denoted by the reference numeral 10 and fabricated in accordance with the principles of the present invention.

The system 10 comprises a first embodiment of the new and novel veneer anchor utilized in the present system and which is denoted by the reference numeral 12.

The system comprises a vertical channel member 14, a wall board 16, the veneer anchor 12, a substantially U-shaped wall-tie 18 and the outer wythe, generally designated 20, which is herein illustrated as being constructed of a plurality of individual bricks 22, but, as will be readily apparent to those skilled in the art, may be constructed of cinder blocks or other similar masonry material, which have regular or irregular configurations.

With particular reference to the construction of the veneer anchor 12, attention is directed to the fact that the same comprises a backing plate member 24 and a projecting bar portion 26. The bar portion 26 is punched-out from the central portion of the stock plate member 24 so as to result in a centrally disposed aperture 28 of substantially rectangular configuration being formed in the plate member 24. The projecting bar portion 26 is thus disposed in substantially parallel relationship with respect to the plate member 24; however, the upper and lower ends 30 of the projecting bar portion 26 are slightly arcuate to permit the forward projection of the bar portion 26 with respect to said plate member. The plate member is also provided with bores 32 at the upper and lower ends thereof, the purpose of which will be discussed in more detail hereinafter.

As best seen in FIG. 2, the projecting bar portion 26 is sufficiently spaced from the plate member 24 so as to form a slot 34 therebetween. The slot 34 being adapted to receive the wall-tie 18 therewithin, as clearly indicated in FIGS. 1 and 2.

In the fabrication of the dry wall construction system 10, the channel members 14 are initially secured in place. In this regard, attention is directed to the fact that the members 14 may also comprise the standard framing members of an edifice. The wall board 16 which may be exterior grade gypsum board is then positioned in abutting relationship with the forward flange 40 of the channel member 14. A carpenter then places the anchors 12 in abutting engagement with the front surface 42 of the wall board 16, and thereafter, simultaneously secures both the anchor 12 and the wall board 16 with respect to the front flange 40, and thus, the channel member 14 by inserting sheet metal screws 44 into the bores 32 and then fastening the same through the wall board 16 and the metal of the flange 40, as best seen in FIG. 2. This completes the preliminary assembly of the system 10.

Subsequently, the mason inserts the substantially U-shaped wall-ties 18 in the slot 34 formed between the projecting bar portion 26 and the back plate member 24 of each of the veneer anchors 12. Thereafter, fabrication of the outer wythe is commenced utilizing the bricks 22 with the horizontal and vertical joints therebetween being filled with mortar, as at 46 and 48, respectively.

As will be readily apparent, the wall-tie 18 is vertically adjustable in the orientation of the veneer anchor, as depicted in the drawings, whereby a mason has no difficulty in positioning the open ends 50 of the wall-tie in the course of bricks which he deems most appropriate. This is accomplished by merely sliding the base portion 52 of the wall-tie within the slot 34 along the longitudinal dimension of the projecting bar 26.

Attention is also directed to the fact that since the dimension of the base 52 of the wall-tie 18 is greater than the lateral dimension of the projecting portion 26, there is also provided limited lateral movement of the wall-tie 18 with respect to the veneer anchor 12, so as to obviate the undesirable possibility of the wall-tie being positioned across a vertical joint 48 of the outer wythe 20, in certain applications; and to provide limited lateral adjustability and limited rotational adjustability should the same be required.

The wall-tie 18 is also provided with a vertical detent 54 to permit the wall-tie 18 to additionally function as a drip tie to cause any water flowing along the horizontally disposed legs 56 of the tie to drop downwardly in the space between the outer wythe 20 and the wall board 16 and thereby prevent any water seepage inwardly toward said wall board.

It will thus be apparent that the anchor 12 is capable of simple and easy securement and fastening, by a carpenter, to both the wall board 16 and the channel number 14 in a single operation. Once this preliminary assembly has been completed, as described hereinabove, it is relatively simple for the mason to insert the wall-ties 18 in the slot 34 and thereby determine the positions of securement of the wall-ties with respect to the outer wythe construction 20.

Referring now to FIG. 4, there is shown a second embodiment of the present invention wherein similar parts are denoted by similar reference numerals. In this embodiment, the plate number 24A is of sheet-like construction and has a substantially U-shaped rod member 26A connected thereto. The rod 26A forms the projecting bar portion of the veneer anchor 12A and is provided with integrally formed legs 30A which are welded to the plate 2A, as at 62. The plate member 24A is also provided with upper and lower bores 32A, the purpose of which was described hereinabove in conjunction with FIGS. 1 through 3. The wall-tie 18A utilized in this embodiment may be that known as a vee-tie having open ends 50A to facilitate the insertion of the wall-tie in the slot formed between the projecting bar portion 26A and the plate member 24A.

Although the veneer anchor has been shown and described as being disposed in vertical orientation, the same is capable of disposition in any angular relationship desired.

In this regard, in some applications, it will be desirable to dispose the veneer anchors with the longitudinal dimension thereof disposed in a substantially horizontal plane so as to permit limited vertical adjustability and relatively extensive horizontal adjustability.

Attention is directed to the fact that the plate members 24 and 24A of the first and second embodiments of the veneer anchors described hereinabove serve a dual function. In this regard, the plate members 24 and 24A initially provide the securement of the veneer anchor to the wall board and channel member which is a singular fastening operation. Once secured in the foregoing manner, the back plates 24 and 24A provide a protective abutment surface with regard to the wall-ties 18 and 18A. More particularly, in the event the wall-ties are caused to exert any inward force toward the interior of the resulting edifice, the force thereof will be absorbed and distributed by the plate members, thereby preventing the wall-ties from being urged inwardly into the front surface 42 of the wall board, which would, under normal circumstances, result in the breaking of the wall board construction, destroying the rigidity thereof and which may produce a crack resulting in the seepage of air, water and moisture through the wall board barrier. In the dry wall construction system of the present invention, this deleterious effect is prohibited by virtue of the secondary function served by the back plate members 24 and 24A.

With reference now to FIG. 5, there is shown a third embodiment of the veneer anchor construction of the present invention, similar in construction to the first embodiment, and wherein, similar parts are denoted by similar reference numerals.

Figure 6:
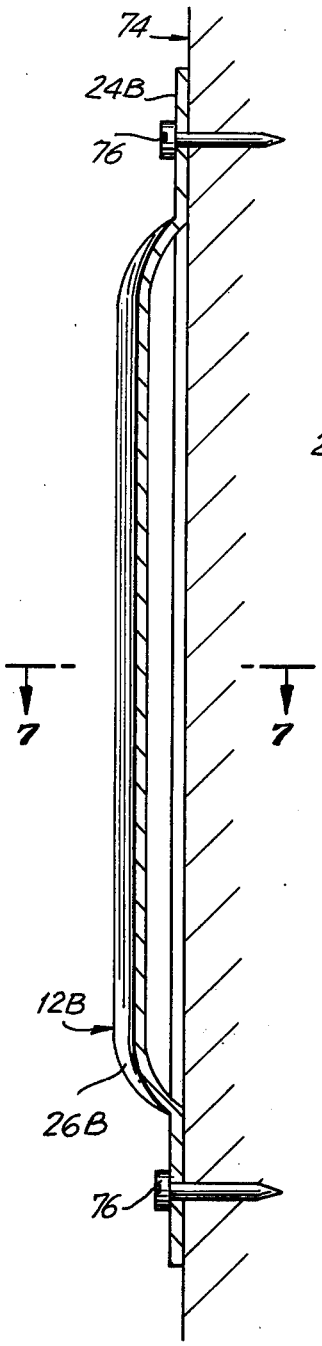
FIG. 6 is a sectional view taken along the line 6—6 of FIG. 5.
Figure 7:
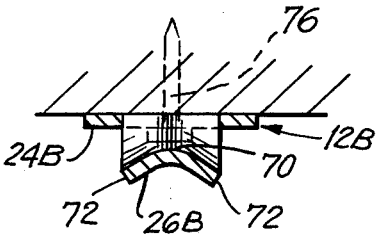
FIG. 7 is a lateral sectional view of the veneer anchor construction taken on the line 7—7 of FIG. 6.
Figure 8:
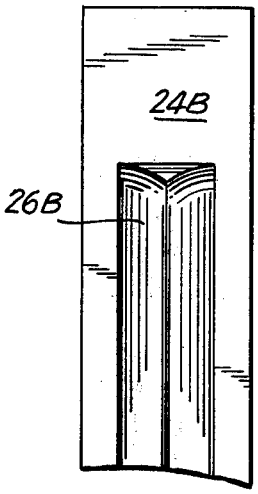
FIG. 8 is a front view of the upper portion of the veneer anchor construction of FIG. 5 prior to securement thereof to a masonry wall.

The anchor 12B comprises a backing plate member 24B, having a projecting bar portion 26B formed integrally therewith. The projecting bar portion 26B is of substantially V-shaped configuration; i.e., having a V-shaped cross-section. The bar 26B is punched-out from the central portion of the stock plate member 24B, to thereby form a longitudinally, centrally disposed aperture 28B in the plate 24B and which aperture has a substantially rectangular configuration. The apex 70 of the V-shaped bar portion 26B is disposed in closer proximal relationship to the back plate 24B than are the side edges 72 of the bar portion. The veneer anchor 12B may be provided with bores, in the manner disclosed hereinabove in conjunction with FIGS. 1 and 2, so as to be utilized in the dry wall construction, discussed hereinabove. Alternatively, the plate member 24B may be formed with no apertures therein, as clearly depicted in FIG. 8, and may be secured to a masonry inner wythe 74 by shooting nails, such as 76, through the upper and lower portions of the plate member 24B, as is clearly illustrated in FIGS. 5 and 6.

It will thus be apparent that the veneer anchor construction of FIGS. 5 through 8 can be used in a multiplicity of masonry applications and for securing masonry outer wythe constructions of regular or irregular configuration to an inner wythe member or to the frame of an edifice.

The V-shaped construction of the projecting bar member 26B lends rigidity and strength thereto so as to provide a more reliable and secure connection when said anchor 12B is used in conjunction with wall-ties, such as wall-ties 18 and 18A, discussed and described hereinabove.

It will thus be apparent to those skilled in the art that the present invention provides new and novel veneer anchor constructions and new and novel dry wall construction systems which are capable of easy and direct fabrication by those skilled in the art.

While I have shown and described the preferred embodiments of the present invention, it will be readily apparent to those skilled in the art, that there are many changes, modifications and improvements which can be made therein without departing from the spirit and scope of the invention as hereinabove defined and envisioned and as hereinafter claimed.

What is claimed is:

1. An improved veneer anchor apparatus comprising
a substantially planar plate member having a longitudinal and a lateral dimension,
a longitudinally extending bar member having first and second spaced apart ends,
means for fixedly securing each of the ends of said bar member to said plate member in a manner whereby said bar member is disposed forwardly of said plate member in substantially parallel relationship therewith, and
said plate member and said bar member form a slot therebetween.

2. A veneer anchor apparatus in accordance with claim 1, wherein
said plate member is provided with at least one bore in the upper portion thereof, and
said plate member is provided with at least one bore in the lower portion thereof.

3. A veneer anchor apparatus in accordance with claim 1, wherein
said longitudinally extending bar member is disposed substantially in the center of the lateral dimension of said plate member.

4. A veneer anchor apparatus in accordance with claim 1, wherein
said plate member has a substantially continuous mass,
said bar member has arcuate end portions, and
means for securing the inner end of each of said end portions to said plate member.

5. A veneer anchor apparatus in accordance with claim 1, wherein
said bar member and said plate member are formed integrally with one another.

6. A veneer anchor apparatus in accordance with claim 5, wherein
said bar member comprises a punched-out portion of said plate member which is disposed centrally with respect to the lateral dimension of said plate member.

7. A veneer anchor apparatus in accordance with claim 4, wherein
the inner end of each of said end portions are welded to said plate member.

8. A dry wall construction system comprising
a plurality of support members secured with respect to one another and forming the frame of an edifice,
at least one wall board disposed in abutting engagement with the outer surface portion of selective ones of said support members,
at least one veneer anchor disposed in abutting engagement with the front surface of said wall board,
said veneer anchor comprising
a plate member, and
a projecting bar member,
means for fixedly securing said projecting bar member to said plate member in a manner to form a slot therebetween,
the rear surface of said plate member being disposed in tangential coextensive relationship with a portion of the front surface of said wall board,
means for concomitantly securing said plate member, said wall board and a selected one of said support members with respect to one another,
a wall-tie member having one end portion thereof positionally disposed in said slot between the plate member and the projecting bar member of said veneer anchor,
an outer wythe assembly, and
said wall-tie member being adjustably positionable along the longitudinal dimension of said projecting bar portion within said slot to permit selective positioning and securement of the other end portion of said wall-tie member within said outer wythe assembly.

9. A dry wall construction system in accordance with claim 8, wherein
said support members comprise channel members.

10. A dry wall construction system in accordance with claim 8, wherein
said concomitant securement means comprises
a plurality of bores formed in said place member, and
sheet metal screws inserted within said bores threadedly engaging said wall board and said selected support member.

11. A dry wall construction system in accordance with claim 10, wherein
said selected support member comprises a vertical channel member, and
said bores comprise at least first and second bores formed in the upper and lower end portions of said plate member, respectively.

12. A dry wall construction system in accordance with claim 8, wherein
said plate member has a longitudinal dimension and a lateral dimension, and
said longitudinally extending bar member is disposed substantially in the center of the lateral dimension of said plate member.

13. A dry wall construction system in accordance with claim 12, wherein
said plate member has contiguity,
said bar member has arcuate end portions, and
means for securing the inner end of each of said end portions to said plate member.

14. A dry wall construction system in accordance with claim 8, wherein
said bar member and said plate member are formed integrally with one another.

15. A dry wall construction system in accordance with claim 14, wherein
said bar member comprises a punched-out portion of said plate member which is disposed centrally with respect to the lateral dimension of said plate member.

16. A dry wall construction system in accordance with claim 13, wherein
the inner end of each of said end portions are welded to said plate member.

17. A dry wall construction system in accordance with claim 15, wherein
said concomitant securement means comprises
a plurality of bores formed in said plate member, and
sheet metal screws inserted within said bores threadedly engaging said wall board and said selected support member.

18. A dry wall construction system in accordance with claim 17, wherein
said selected support member comprises a vertical channel member, and
said bores include at least first and second bores formed in the upper and lower end portions of said plate member, respectively.

19. A veneer anchor apparatus in accordance with claim 1, wherein
said longitudinally extending bar member has a substantially V-shaped cross-section.

20. A veneer anchor apparatus in accordance with claim 19, wherein
said V-shaped bar member has an apex and a pair of side edges, and
said apex being positionally disposed in closer proximal relationship to said plate member than said side edges.

21. A veneer anchor apparatus in accordance with claim 6, wherein
said longitudinally extending bar member has a substantially V-shaped cross-section.

22. A veneer anchor apparatus in accordance with claim 21, wherein
said V-shaped bar member has an apex and a pair of side edges, and
said apex being positionally disposed in closer proximal relationship to said plate member than said side edges.

23. A veneer anchor apparatus in accordance with claim 8, wherein
said projecting bar member has a substantially V-shaped cross-section.

24. A veneer anchor apparatus in accordance with claim 23, wherein
said V-shaped bar member has an apex and a pair of side edges, and
said apex being positionally disposed in closer proximal relationship to said plate member than said side edges.

25. A veneer anchor apparatus in accordance with claim 15, wherein
said projecting bar member has a substantially V-shaped cross-section.

26. A veneer anchor apparatus in accordance with claim 25, wherein
said V-shaped bar member has an apex and a pair of side edges, and
said apex being positionally disposed in closer proximal relationship to said plate member than said side edges.

27. A wall construction system comprising
an inner wythe assembly, and
an outer wythe assembly,
at least one veneer anchor disposed in abutting engagement with the front surface of said inner wythe assembly,
said veneer anchor comprising
a plate member, and
a projecting bar member having first and second spaced apart ends,
means for fixedly securing each of said ends of said projecting bar member to said plate member in a manner to form a slot therebetween,
the rear surface of said plate member being disposed in tangential coextensive relationship with a portion of the front surface of said inner wythe assembly,
means for securing said plate member to said inner wythe assembly,
a wall-tie member having one end portion thereof positionally disposed in said slot between the plate member and the projecting bar member to said veneer anchor, and
said wall-tie member being adjustably positionable along the longitudinal dimension of said projecting bar portion within said slot to permit selective positioning and securement of the other end portion of said wall-tie member within said outer wythe assembly.

28. A wall construction system in accordance with claim 27, wherein
said means for securing said plate member to said inner wythe assembly comprises nails forcibly projected through said plate member into said inner wythe assembly.

29. A wall construction system in accordance with claim 27, wherein
said plate member has a longitudinal dimension and a lateral dimension, and
said longitudinally extending bar member is disposed substantially in the center of the lateral dimension of said plate member.

30. A wall construction system in accordance with claim 29, wherein
said plate member has a substantially continuous mass
said bar member has arcuate end portions, and
means for securing the inner end of each of said end portions to said plate member.

31. A wall construction system in accordance with claim 27, wherein
said bar member and said plate member are formed integrally with one another.

32. A wall construction system in accordance with claim 31, wherein
said bar member comprises a punched-out portion of said plate member which is disposed centrally with respect to the lateral dimension of said plate member.

33. A wall construction system in accordance with claim 32, wherein
said projecting bar member has a substantially V-shaped cross-section.

34. A wall construction system in accordance with claim 33, wherein said V-shaped bar member has an apex and a pair of side edges, and said apex being positionally disposed in closer proximal relationship to said plate member than said side edges.

* * * * *

UNITED STATES PATENT OFFICE

CERTIFICATE OF CORRECTION

Patent No. 4,021,990 Dated May 10, 1977

Inventor(s) Bernard J. Schwalberg

It is certified that error appears in the above-identified patent and that said Letters Patent are hereby corrected as shown below:

Column 6, line 44,"place" should read -- plate --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*

REEXAMINATION CERTIFICATE (91st)

United States Patent [19]

Schwalberg

[11] B1 4,021,990

[45] Certificate Issued Jun. 7, 1983

[54] VENEER ANCHOR AND DRY WALL CONSTRUCTION SYSTEM AND METHOD

[75] Inventor: Bernard J. Schwalberg, Brooklyn, N.Y.

[73] Assignee: Hohmann Enterprises, Inc., Birmingham, Ala.

Reexamination Request

No. 90/000,173, Mar. 11, 1982

Reexamination Certificate for:

| | |
|---|---|
| Patent No.: | **4,021,990** |
| Issued: | **May 10, 1977** |
| Appl. No.: | **652,867** |
| Filed: | **Jan. 27, 1976** |

Certificate of Correction issued Jul. 23, 1977.

[51] Int. Cl.[3] ..... E04B 1/38; E04B 1/16

[52] U.S. Cl. ..... 52/479; 52/379; 52/564; 52/712; 52/714

[58] Field of Search ..... 52/712, 713, 714, 562; 52/508, 426, 428, 385, 384, 479

[56] References Cited

U.S. PATENT DOCUMENTS

| | | | |
|---|---|---|---|
| 819,869 | 5/1906 | Dunlap. | |
| Re.15,979 | 1/1925 | Schaeffer | 52/379 |
| 1,734,364 | 11/1929 | Cole. | |
| 2,058,148 | 10/1936 | Hard | 52/714 |
| 2,389,965 | 11/1945 | Eckel | 52/508 |
| 3,740,912 | 6/1973 | Sauer | 52/483 |

FOREIGN PATENT DOCUMENTS

| | | |
|---|---|---|
| 671341 | 10/1965 | Belgium. |

OTHER PUBLICATIONS

"FB Masonry Accessories", published by Hohmann & Barnard, Inc., copyright 1975, labeled 4.8/HO—sec page 5 thereof.

*Primary Examiner*—A. C. Perham

[57] ABSTRACT

There is provided a veneer anchor for use in a dry wall construction system. The veneer anchor comprises a plate member having a vertically projecting bar portion secured thereto and disposed in substantially parallel relationship with said plate member. The anchor is employed to secure a wall board to a vertical channel or standard framing member. Thereafter, a mason inserts a wall-tie between the plate member and projecting bar portion and the wall-tie is built into the outer wythe of the wall system. The wall-tie is capable of vertical movement and thus, vertical adjustability along the length of the projecting bar portion.

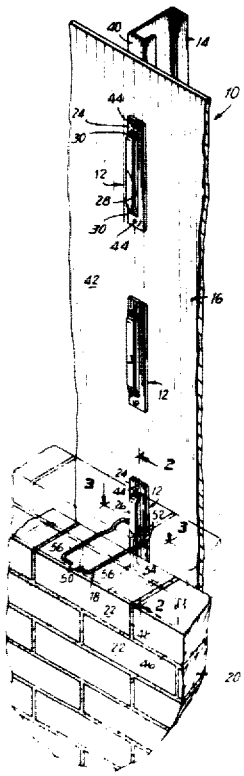

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–18 and 27–34 is confirmed.

Claims 1 and 23–26 are determined to be patentable as amended:

1. An improved veneer anchor [apparatus] *assembly* comprising

*a veneer anchor apparatus, and*

*a wall-tie member,*

*said veneer anchor apparatus comprising* a substantially planar plate member having a longitudinal and a lateral dimension, a longitudinally extending bar member having first and second spaced apart ends, means for fixedly securing each of the ends of said bar member to said plate member in a manner whereby said bar member is disposed forwardly of said plate member in substantially parallel relationship therewith, [and]

said plate member and said bar member [form] *forming* a slot therebetween[.],

*said wall-tie member having one end portion thereof positionally disposed in the slot between said substantially parallel plate and projecting bar members of said veneer anchor apparatus, and*

*said end portion of said wall-tie member being capable of longitudinal movement within said slot to enable adjustable positioning of said wall-tie member along the longitudinal extension of said slot.*

23. [A veneer anchor apparatus] *A dry wall construction system* in accordance with claim 8, wherein said projecting bar member *of said veneer anchor* has a substantially V-shaped cross-section.

24. [A veneer anchor apparatus] *A dry wall construction system* in accordance with claim 23, wherein said V-shaped bar member has an apex and a pair of side edges, and said apex being positionally disposed in closer proximal relationship to said plate member than said side edges.

25. [A veneer anchor apparatus] *A dry wall construction system* in accordance with claim 15, wherein said projecting bar member *of said veneer anchor* has a substantially V-shaped cross-section.

26. [A veneer anchor apparatus] *A dry wall construction system* in accordance with claim 25, wherein said V-shaped base member has an apex and a pair of side edges, and said apex being positionally disposed in closer proximal relationship to said plate member than said side edges.

Claims 2–7 and 19–22, dependent on amended claims, are determined to be patentable.

* * * * *